United States Patent [19]

Uemura

[11] 4,063,542

[45] Dec. 20, 1977

[54] ULTRASONIC LAPPING APPARATUS FOR DRAWING DIES

[75] Inventor: Yasukuni Uemura, Tokyo, Japan

[73] Assignee: Nissin Diamond Co., Ltd., Tokyo, Japan

[21] Appl. No.: 633,557

[22] Filed: Nov. 19, 1975

[30] Foreign Application Priority Data

Aug. 21, 1975 Japan ..... 50-101581

[51] Int. Cl.[2] ..... B28D 5/00

[52] U.S. Cl. ..... 125/30 WD; 51/59 SS

[58] Field of Search ..... 51/59 SS; 125/30 WD

[56] References Cited

U.S. PATENT DOCUMENTS

| | | | |
|---|---|---|---|
| 2,292,550 | 8/1942 | Simons | 125/30 WD |
| 2,350,023 | 5/1944 | Ferrier | 125/30 WD |
| 2,398,250 | 4/1946 | Robbins | 125/30 WD |
| 2,441,004 | 5/1948 | Bieberich | 125/30 WD |
| 2,834,158 | 5/1958 | Petermann | 51/59 SS |
| 3,592,084 | 7/1971 | Gelfand | 125/30 WD |

*Primary Examiner*—Harold D. Whitehead

*Attorney, Agent, or Firm*—Irving M. Weiner; Pamela S. Austin

[57] ABSTRACT

For lapping the surfaces defining a hole in a wiredrawing die of diamond or artificial material, one or more transducers are excited by respective ultrasonic generators to produce mechanical vibrations imparted to lapping needles. Turntables arranged opposite to the tips of the lapping needles are rotated from a common drive shaft and, simultaneously, each rolled or swayed about an axis passing through the die mounted thereon. A cam or crank mechanism driven from the common drive shaft is employed for the rolling motion of each turntable. The apparatus further comprises means for fine adjustment of the position of each turntable relative to the lapping needle in a plane at right angles therewith, and means for yieldably urging the die on the turntable against the lapping needle under adjustable pressure.

3 Claims, 6 Drawing Figures

ULTRASONIC LAPPING APPARATUS FOR DRAWING DIES

BACKGROUND OF THE INVENTION

My invention relates generally to the art of ultrasonic machining, and more specifically to ultrasonic lapping apparatus for refining the surface finish and geometrical accuracy of holes in drawing dies and, in particular, in such dies made from diamond or like hard material for drawing fine wires.

For drawing small sizes of wire, dies have been used extensively which are made from diamond, agate or the like or from artificial materials of greater hardness which have been recently developed. When they are properly made, the use of these dies is economical as they retain their accuracy for a long time. The hole in the wiredrawing die, through which the wire is drawn, usually comprises three major zones, the first being a tapered or cone-shaped approach at the entrance end where the actual reduction takes place in size of the wire. The second is a short cylindrical zone known as the bearing or land, where the roundness and size of the wire is determined. Then comes the third zone in the form of a reverse taper at the exit end, sometimes referred to as a back relief, which strengthens the exit end of the die and prevents the end of the bearing from spalling.

It has been known to employ the ultrasonic machining method to lap or finish the internal surfaces of the wiredrawing dies in question, as the method is applicable expeditiously to holes of extremely small diameters. The ultrasonic die lapping apparatus as heretofore suggested and used, however, is subject to the disadvantage that it depends much on manual assistance from the skilled operator to guide the lapping tool along the internal die surfaces of intricate shape. The operator of the conventional apparatus usually needs an experience of at least five years or so, and even then he may sometimes fail to operate the apparatus with truly satisfactory results.

The finishing operation of the wiredrawing dies has been highly time-consuming. For lapping a die with a bearing diameter of 0.9 millimeter to a desired degree of finish by use of the conventional apparatus, about one hour is required if the die is made from diamond, and well over ten hours if it is made from artificial material of greater hardness. The dies of artificial material, moreover, are difficult to lap to as smooth a finish as diamond dies, perhaps by reasons of the extreme hardness and crystal structure of the artificial material. The conventional ultrasonic lapping apparatus has thus been in need of substantial improvement to establish its true practical utility in conjunction with the drawing dies of the class under consideration.

SUMMARY OF THE INVENTION

It is an object of my invention to provide improved ultrasonic lapping apparatus for efficiently finishing or reconditioning holes in drawing dies made from diamond and, above all, artificial material of greater hardness, in such a manner that the apparatus only requires supervision by semiskilled labor.

Another object of the invention is to provide apparatus of the character defined wherein a die mounted on a turntable is not only rotated relative to a lapping needle but is also rolled or swayed to and fro to permit the ultrasonically oscillating needle to move along the tapered surfaces of the hole in the die.

A further object of the invention is to provide, in the apparatus of the above described character, means for fine adjustment of the position of the turntable relative to the lapping needle in a plane at right angles therewith so that the hole in the die mounted thereon may be located precisely in a desired position with respect to the needle.

A further object of the invention is to provide, in the apparatus of the above described character, means for yieldably urging the die on the turntable against the lapping needle under pressure which is easily and effortlessly adjustable to suit the particular die to be machined.

It is also an object of this invention to provide ultrasonic lapping apparatus capable of simultaneously finishing and/or reconditioning holes in two or more drawing dies.

Briefly, the ultrasonic lapping apparatus according to this invention includes a lapping needle adapted to receive mechanical ultrasonic oscillations from a transducer which is excited by an ultrasonic generator at a desired ultrasonic frequency. A turntable for supporting a workpiece thereon is arranged opposite to the tip of the lapping needle, normally in axial alignment therewith. The apparatus further comprises drive means for rotating the turntable about its axis relative to the lapping needle, and rolling means for causing the turntable to roll about an axis passing through the die mounted in position thereon. The rolling means comprises a swing arm carrying the turntable and pivotally supported at one end for swinging motion about the axis passing through the die on the turntable, and actuating means adjacent the other end of the swing arm for causing its swinging motion.

According to a preferred embodiment of this invention, the apparatus integrally comprises two ultrasonic lapping units with their transducers excited by respective ultrasonic generators. Excitation of two or more transducers by a common ultrasonic generator is possible but it does not result in the same operating characteristics of the lapping needles, as has been confirmed by experiment. The use of a common generator, moreover, would make it impossible to control the performance of each lapping needle, so that the apparatus would be incapable of simultaneously reconditioning dies worn or damaged in different ways. For these reasons each lapping unit has its own ultrasonic generator in the preferred form of the apparatus according to the invention.

The foregoing and other features and objects of this invention and the manner of attaining them will become more apparent and the invention itself will best be understood by reference to the following description of the embodiment of the invention, taken in connection with the accompanying drawings.

DESCRIPTION OF THE PREFERRED EMBODIMENT

In the accompanying drawings the invention is shown adapted for ultrasonic die lapping apparatus of dual type, that is, apparatus integrally comprising a pair of ultrasonic lapping units sharing a drive mechanism and excited by separate ultrasonic generators. It is understood, however, that there can be provided apparatus incorporating a single or three or more such lapping units within the range of equivalents of this invention, as will become evident from the following description.

Figure 1:
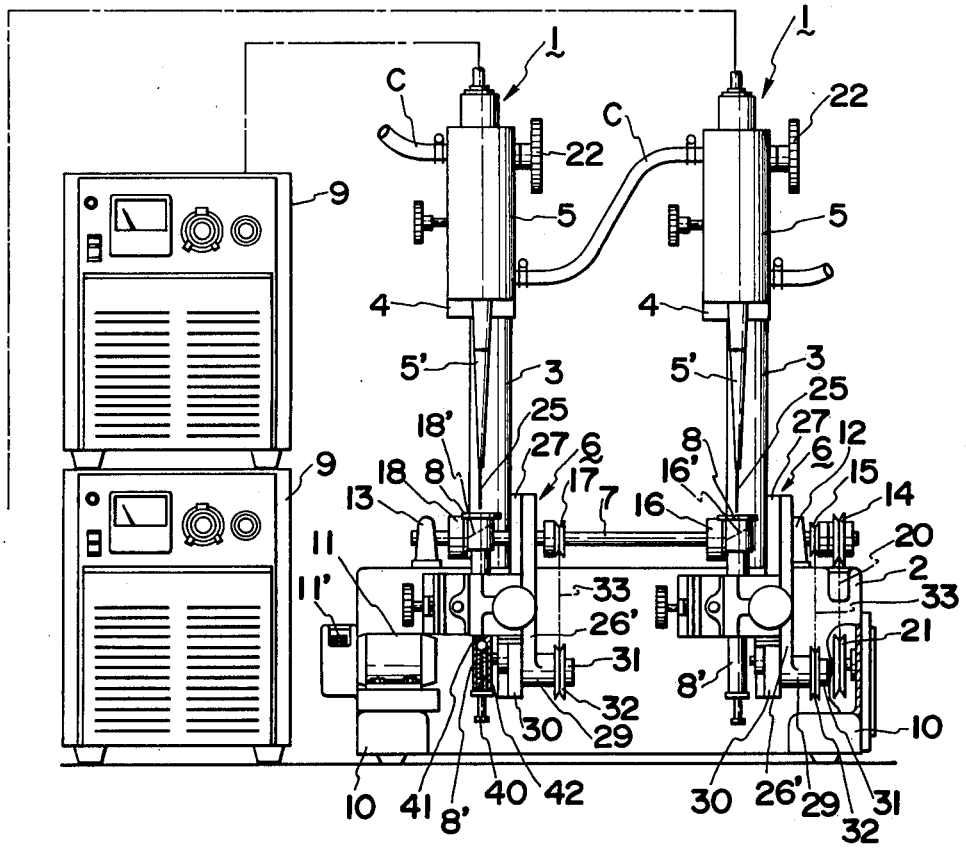
FIG. 1 is a front elevational view, partly broken away, of ultrasonic lapping apparatus constructed in accordance with the novel concepts of this invention.
Figure 2:
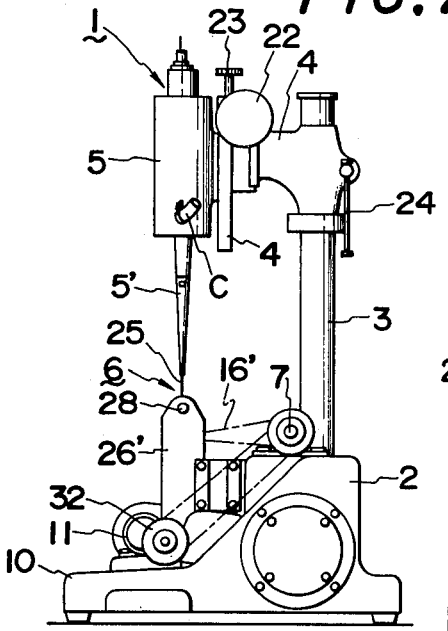
FIG. 2 is a right-hand side elevational view of the apparatus of FIG. 1, the view not showing the ultrasonic generators.

With reference more particularly to FIGS. 1 and 2 the integrated pair of lapping units 1 constituting one adaptation of this invention comprises a common pedestal 2, a pair of upstanding standards or columns 3 mounted on the pedestal and each having an offset arm 4, a pair of transducers 5 mounted on the respective arms so as to be adjustably movable up and down relative to same, a pair of turntables 8 carried by respective rolling mechanisms 6 and rotated from a common drive shaft 7, and a pair of ultrasonic generators 9 shown housed in respective consoles and electrically connected to the respective transducers.

The pedestal 2 can be an iron casting, complete with a pair of legs 10 projecting forwardly therefrom to bear the weight of the offset arms 4 of the standards 3, the transducers 5 and so forth. An electric motor 11 may be mounted on one of the legs 10 to drive a needle grinder 11' for reconditioning the lapping needles of the apparatus as necessary.

The common drive shaft 7 is arranged horizontally over the pedestal 2 and is rotatably supported by a pair of bearings 12 and 13 mounted thereon. Five pulleys 14, 15, 16, 17 and 18 are fixedly mounted on the drive shaft 7. An endless belt 20 extends around the pulley 14 and another pulley 21 which is accommodated within the pedestal 2 and which is coupled, either directly or indirectly, to the output shaft of an electric drive motor, not shown, also arranged within the pedestal. The drive shaft 7 is thus driven from the unshown drive motor via the belt 20.

As will be seen from FIG. 2, the transducer 5 of each lapping unit is mounted on the offset arm 4 of the standard 3 via a rack-and-pinion mechanism designed to afford fine adjustment of the position of the transducer toward and away from the turntable 8. A knurled knob 22 is for such fine manual adjustment of the transducer position, and another knurled knob 23 for securing the transducer in a desired position with respect to the turntable 8.

In the illustrated embodiment of the invention each offset arm 4 with its tranducer 5 is also adjustably slidable up and down over the standard 3 and can be clamped in any desired position thereon by a lever 24. The offset arm may be counterweighted to balance the weight of the transducer and so forth.

Each transducer 5 has a tool holder 5' extending downwardly therefrom, and a tool in the form of a lapping needle 25 is shown attached to the tool holder. As is well known, the transducer is excited by the ultrasonic generator 9 at a desired ultrasonic frequency and converts the electric energy into mechanical oscillations to drive the lapping needle 25. Shown at C are flexible conduits constituting parts of the usual cooling water circuit for the transducers.

Figure 3:
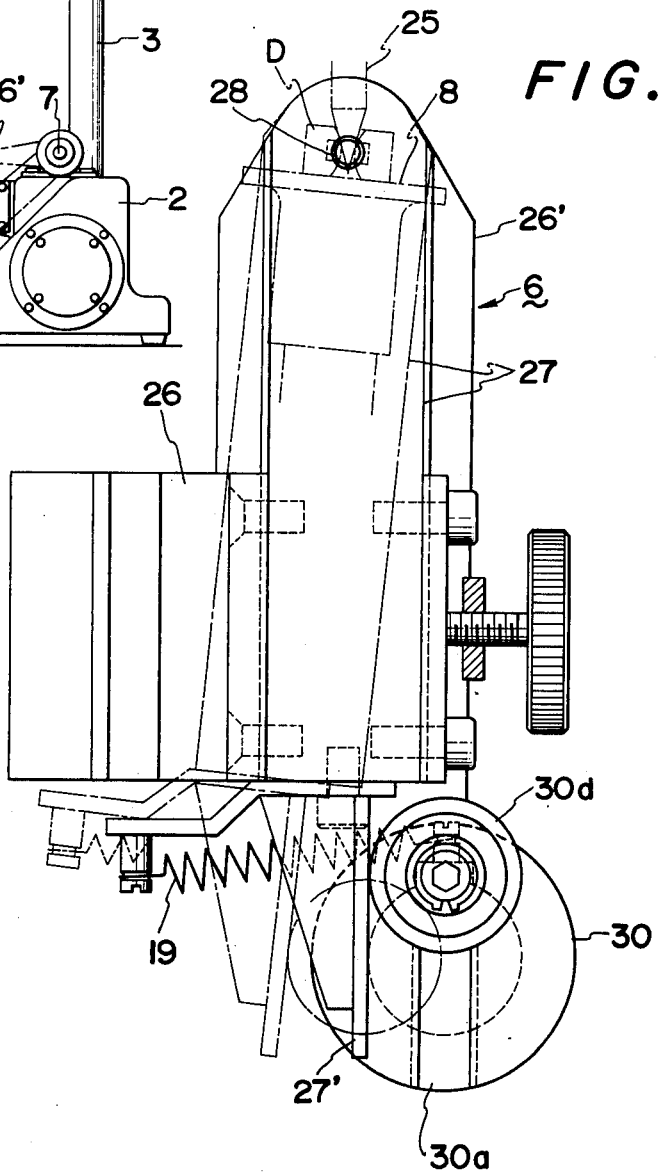
FIG. 3 is an enlarged, partial left-hand side elevational view of one of the lapping units of FIG. 1, the view being explanatory of the construction and operation of a mechanism to cause the rolling motion of the turntable.
Figure 4:
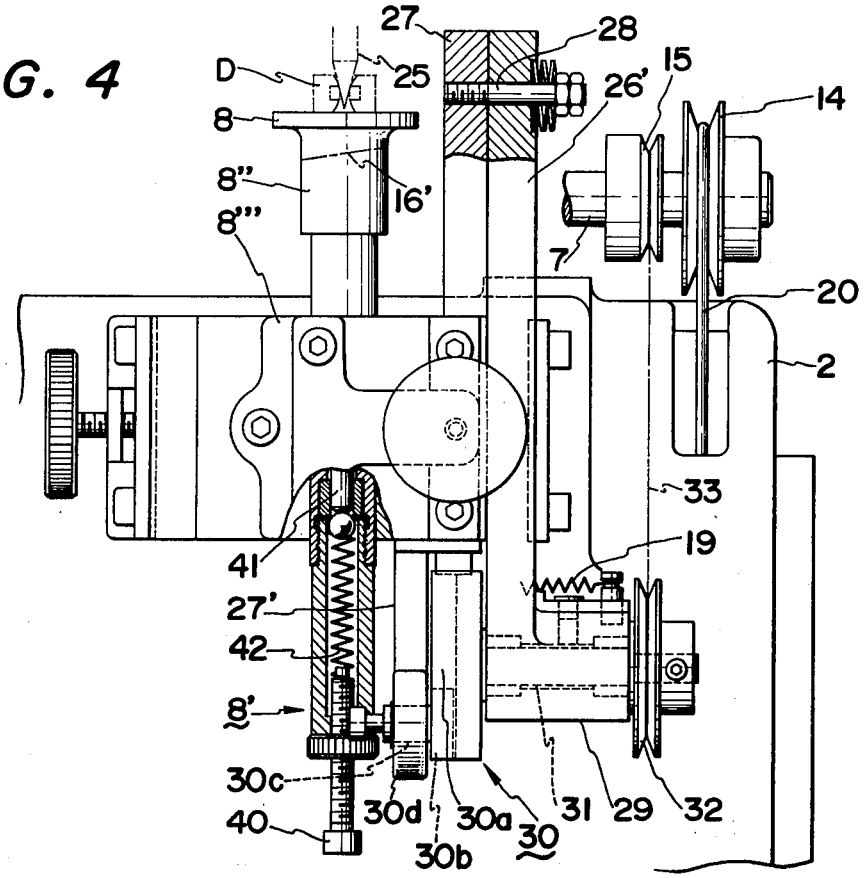
FIG. 4 is an enlarged, fragmentary front-elevational view, partly in vertical section and partly broken away, of the right-hand lapping unit of the apparatus of FIG. 1, the view showing in greater detail the rolling mechanism and adjustable bearing of the turntable.

As shown also in FIGS. 3 and 4, each lapping needle 25 has its tip arranged opposite to the turntable 8 rotatably supported by a bearing 8' with means for yieldably urging the turntable upwardly under adjustable pressure. This bearing is herein termed the adjustable bearing and is later described with reference to FIG. 4 or 6. The turntable 8 in its normal position is in axial alignment with the lapping needle.

Figure 5:
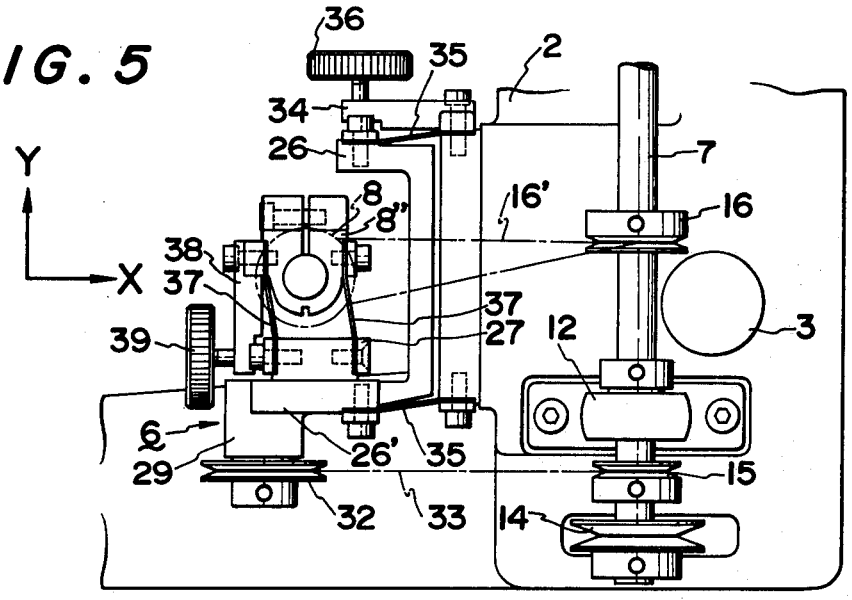
FIG. 5 is an enlarged, fragmentary top plan view showing in detail a mechanism for adjusting the position of the turntable relative to the lapping needle in a plane at right angles therewith, and other associated means in the right-hand lapping unit of the apparatus of FIG. 1.

Each turntable 8 is shown to be formed integral with a pulley 8" in coaxial relationship thereto, and endless belts 16' and 18' extend respectively around these turntable pulleys and the aforesaid pulleys 16 and 18 on the drive shaft 7, as will be seen from a consideration of FIGS. 1, 2 and 5. The turntables 8 of both lapping units are thus rotated by the common drive shaft 7 via the belts 16' and 18'.

According to the concepts of this invention each turntable 8 should not only be rotated about its central axis but should also be rolled, that is, swayed to and fro with an amplitude which is easily adjustable, to facilitate the lapping operation of the tapered hole in the drawing die mounted in position thereon. It is for this purpose that each lapping unit 1 incorporates the rolling mechanism 6.

As best shown in FIGS. 3 to 5, each rolling mechanism 6 includes a post 26' constituting a part of a supporting frame 26, and a swing arm 27 pivotally coupled at or adjacent its top end to the post 26' by a pivot pin 28 which may be partly threaded and equipped with suitable means to prevent loosening. The turntable 8 is mounted on the swing arm 27 via its adjustable bearing 8', in a manner described later with reference to FIG. 5, for simultaneous swinging or rolling motion therewith.

It is important to note in conjunction with FIG. 3 that the phantom drawing die D shown mounted in position on the turntable 8 is located on an extension of the axis of the pivot pin 28 about which the swing arm is to swing with the adjustable bearing 8'. The turntable 8, therefore, is made to roll about the axis passing through the die D mounted thereon.

The post 26' terminates at its bottom end in a boss 29 serving as a bearing for a crankshaft 31 extending horizontally therethrough. Mounted on one end of this crankshaft is a rotary cam or crank mechanism including a crank disc 30, whereas on the other end of the crankshaft there is mounted a pulley 32 coupled to the pulley 15 on the drive shaft 7 via an endless belt 33. The cam or crank mechanism forming a part of the rolling mechanism 6 of each lapping unit is thus also driven from the common drive shaft 7.

The crank disc 30 has an undercut guide groove 30*a* formed diametrically or radially thereon, and a slide 30*b* is slidably fitted in this guide groove. The slide 30*b* is provided with a tightening rod or shaft 30*c* on which is rotatably mounted a cam member 30*d*. The tightening rod 30*c* is manually actuatable to hold the slide 30*b*, and therefore the cam member 30*d*, in any selected position in the radial or diametrical direction of the crank disc 30. This adjustment for the degree of eccentricity of the cam member 30*d* with respect to the crank disc 30 is one of the important features of the lapping apparatus according to this invention.

As best shown in FIG. 3, the swing arm 27 has a cam follower 27' extending downwardly therefrom, and a helical compression spring 19 extends between the post 26' swing arm 27 for urging the cam follower into contact with the cam member 30*d* on the crank disc 30. Hence, with the revolution of the cam member 30*d* around the crankshaft 31, the swing arm 27 will be swung to and fro via the cam follower 27' to impart the desired rolling motion to the turntable 8 about the axis passing through the die D mounted thereon. The endless belt 16' should be made of suitably elastic material to permit the rolling motion of the turntable with its pulley 8''.

It will be observed from FIG. 3 that the cam member 30*d* on the crank disc 30 and the cam follower 27' on the swing arm 27 are so arranged with respect to each other that the swing arm may swing to an equal degree on either side of a vertical axis intersecting the axis of the pivot pin 28. The amplitude of this swinging motion is of course adjustable by changing the position of the cam member 30*d* on the crank disc 30 in its radial direction. No swinging motion takes place when the cam member is positioned centrally on the crank disc.

According to a further feature of this invention, the turntable 8 of each lapping unit is made movable relative to the lapping needle 25 in either of two right-angular directions in a horizontal plane, or in a plane at right angles with the lapping needle, for fine readjustment of the position of the turntable with respect to the lapping needle. For this purpose the adjustable bearing 8' of the turntable is supported by means hereinafter described with reference to FIG. 5.

The arrows X and Y in FIG. 5 indicates the respective right-angular directions in which the turntable 8 is to be moved horizontally relative to the lapping needle 25. A bracket 34 projects forwardly from the pedestal 2, and a pair of horizontally spaced leaf springs 35 similarly extend forwardly from the pedestal to support therebetween the aforesaid supporting frame 26 which can be integral with, or rigidly coupled to, the post 26' of the rolling mechanism 6. The pair of leaf springs 35 are designed to permit displacement of the frame 26, and therefore of the turntable 8, only in the Y direction in the horizontal plane and are herein termed the spring supports.

An adjusting screw having a knurled knob 36 extends horizontally through a tapped hole in the bracket 34 and has its tip arranged in abutting contact with the supporting frame 26. The manual turn of the knob 36, therefore, results in the movement of the supporting frame 26 toward and away from the bracket 34 against the forces of the spring supports 35.

A second pair of spaced leaf springs or spring supports 37 extend from the swing arm 27 in a direction at right angles with the first mentioned pair of spring supports 35 to support therebetween the adjustable bearing 8' of the turntable 8 via a holder 8'' shown also in FIG. 4. A bracket 38 is mounted at one end on an adjusting screw having a knurled knob 39 so as to be movable in the X direction with the manual turn of the knob. The other end of the bracket 38 is suitably fastened to the adjustable bearing 8' of the turntable via its holder 8'''.

Thus, with the manual turn of the knob 39, the turntable 8 is movable with the bracket 38 in the X direction relative to the swing arm 27 against the forces of the spring supports 37. Since this swing arm is movable with the supporting frame 26 in the Y direction as above explained, the turntable 8 can be adjustably moved to, and locked in, any desired position in the horizontal plane in order, for example, that the hole in the die D mounted in position thereon may be located in precise alignment with the lapping needle 25.

It is a further feature of this invention that the die D mounted on the turntable 8 of each lapping unit is yieldably urged against the lapping needle 25 under adjustable pressure. Shown at 40 in FIG. 4 is an adjusting screw provided to the adjustable bearing 8' for manual adjustment of the pressure under which the die is to be urged against the lapping needle. The adjustable bearing 8' accommodates a helical compression spring 42 extending between the adjusting screw 40 and a shaft 41 rigidly coupled to the turntable 8 in axial alignment therewith. The upward force exerted on the turntable shaft 41 by the compression spring 42 is adjustably variable by the adjusting screw 40.

According to the adjustable bearing construction of FIG. 4, however, the belt 16' extending around the turntable pulley 8'' and the pulley 16 on the drive shaft 7 will exert a bending stress directly on the turntable shaft 41. Even though it may not actually bend the shaft, this stress seriously impairs the desired smooth rotation and axial movement of the shaft relative to the bearing.

Figure 6:
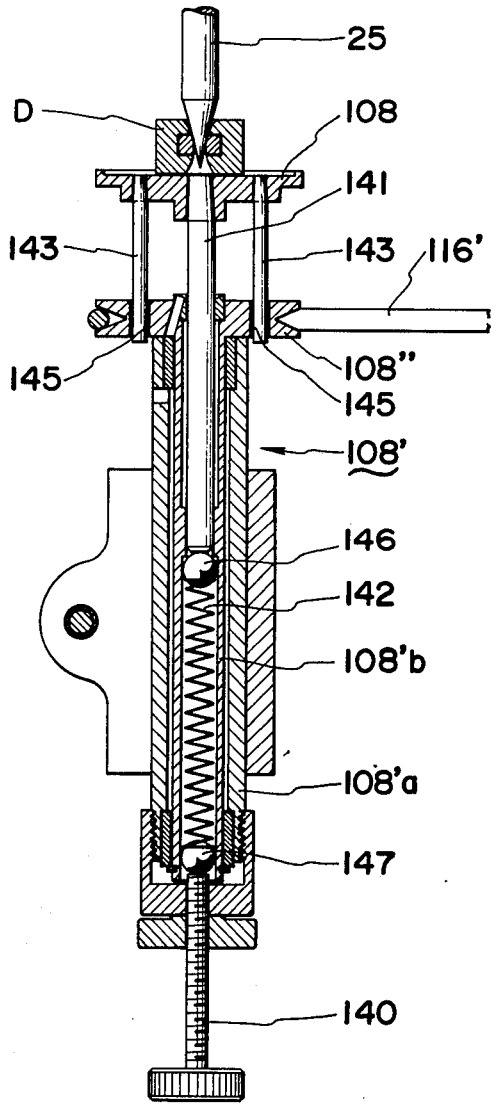
FIG. 6 is a vertical, axial sectional view of a modified form of the turntable and its adjustable bearing for use in each lapping unit of the apparatus of FIG. 1.

FIG. 6 illustrates an improved form of the adjustable bearing which permits smoother rotation and axial movement of the turntable shaft relative to the bearing than the bearing construction of FIG. 4. The various parts shown in FIG. 6 are identified by the same reference characters used to identify the corresponding parts of FIG. 4 in particular, but with the digit "1" or "10" prefixed to such characters except the die D and lapping needle 25.

The improved adjustable bearing generally designated 108' in FIG. 6 is of what may be termed a dual sleeve type, comprising outer and inner sleeves 108'*a* and 108'*b*, with the inner sleeve being rotatably nested in the outer sleeve. The outer sleeve is open at its top end and closed at its bottom, whereas the inner sleeve is open at both ends. The inner sleeve is shown to be integral with a disc-like flange at its top which is circumferentially grooved to provide a pulley 108'' coaxial with a turntable 108. An endless belt 116' extends around this pulley and the pulley 16, FIG. 5, on the drive shaft 7, so that the inner sleeve is rotated relative to the fixed outer sleeve.

A shaft 141 extending downwardly from the turntable 108 is slidably received in the inner sleeve 108'*b*, and at least one, preferably two or more, eccentric connector rods or pins 143 also extend downwardly from the turntable. These connector rods are slidably received in respective holes 145 formed in the pulley 108'' integral with the inner sleeve. The turntable 108 is therefore rotatable simultaneously with the pulley 108'' but movable up and down relative to same.

Within the adjustable bearing 108' the turntable shaft 141 rests on one end of a helical compression spring 142 via a ball 146 of steel or like rigid material. Another similar ball 147 is interposed between the other end of the compression spring 142 and an adjusting screw 140 threadedly extending through the closed bottom of the outer sleeve. The adjusting screw 140 is intended to be turned manually to adjust the pressure under which the die D on the turntable 8 is urged against the lapping needle 25.

The arrangement of FIG. 6 has the advantage that the belt 116' wrapped around the pulley 108" exerts no direct bending stress on the turntable shaft 141. As a consequence, the turntable 108 is smoothly movable up and down relative to the inner sleeve **108'*b*** to permit easy, effortless adjustment of the pressure under which the die on the turntable is urged against the lapping needle.

In operation, a suitable amount of fine abrasive particles may be introduced into the hole in the die mounted in position on each turntable 8 for finishing or reconditioning purposes. The lapping needle 25, inserted into the die hole, is made to oscillate as above explained at the desired ultrasonic frequency, whereas the turntable is made both to rotate about its central axis and to roll about the axis of the pivot pin 25 to a desired degree. The oscillating needle can thus be relatively moved along the surfaces of the die hole to lap same to a desired finish or geometrical accuracy with the aid of the abrasive particles. Two dies can be machined simultaneously by the apparatus disclosed herein.

It has been ascertained by experiment that the apparatus according to this invention is capable of finishing a wiredrawing die of artificial material with a bearing diameter of 0.9 millimeter in about 4 hours, compared with about 10 hours heretofore required to lap the same die to the same degree of finish. The apparatus has also proved to be capable of finishing a diamond die with a bearing diameter of 0.9 millimeter in about 30 minutes, compared with about one hour heretofore required to lap the same die to the same degree of finish.

It is believed that the advantages and improved results of my improved ultrasonic lapping apparatus will be apparent from the foregoing detailed description. It is not desired, however, to limit this invention to the exact details disclosed herein. For example, instead of connecting the turntable 108 of FIG. 6 to the pulley 108" by the connector rods 143, the turntable shaft 141 may be splined to the inner sleeve of the adjusting bearing 108' so as to be rotatable simultaneously therewith but movable longitudinally relative to same. This and other modifications or changes within the ordinary knowledge of those skilled in the art may be resorted to without departing from the true spirit or scope of the invention, as sought to be defined in the following claims.

I claim:

1. In ultrasonic lapping apparatus for finishing or reconditioning holes in drawing dies, the combination of:

a. an ultrasonic generator;
b. a transducer adapted to be excited by said ultrasonic generator to produce mechanical oscillations;
c. a lapping needle adapted to receive the mechanical oscillations from said transducer;
d. a turntable for supporting a die thereon, said turntable being arranged opposite to a tip of said lapping needle and being normally axially aligned therewith;
e. drive means for rotating said turntable about its central axis relative to said lapping needle;
f. rolling means for causing said turntable to roll about an axis passing through the die mounted thereon, said rolling means comprising:
   1. a swing arm pivotally supported at one end for swinging motion about the axis passing through the die on said turntable, said swing arm carrying said turntable; and
   2. means arranged adjacent another end of said swing arm for causing the swinging motion of same;
g. said means for causing the swinging of said swing arm comprises:
   1. a rotary disc;
   2. means for imparting rotation to said disc relative to said swing arm;
   3. a cam mounted on said disc; and
   4. spring means yieldably urging said other end of said swing arm into contact with said cam;
h. means for adjustably moving said turntable in either of two right-angular directions in a plane at right angles with said lapping needle for fine adjustment of the position of said turntable with respect to said lapping needle;
i. said adjustable moving means comprises:
   1. a supporting frame substantially integrally including a portion to which said swing arm is pivotally connected at said one end thereof;
   2. first spring support means supporting said supporting frame, said first spring support means being resiliently yieldable to permit movement of said supporting frame in one of said two right-angular directions relative to said lapping needle;
   3. first manually actuable means for adjustably moving said supporting frame in said one direction against the force of said first spring support means;
   4. second spring support means through which said turntable is mounted on said swing arm, said second spring support means being resiliently yieldable to permit movement of said turntable in the other of said two right-angular directions relative to said swing arm; and
   5. second manually actuable means for adjustably moving said turntable in said other direction against the force of said second spring support means;
j. said first and second support means each comprise a pair of leaf springs;
k. said turntable being coaxially provided with a shaft rotatable simultaneously therewith;
l. a bearing for rotatably supporting said shaft of said turntable;
m. said bearing having means for yieldably urging the die on said turntable against said lapping needle under adjustable pressure; and
n. said bearing including:
   1. an outer sleeve, said turntable being carried by said swing arm via said outer sleeve;
   2. an inner sleeve rotatably nested in said outer sleeve and formed substantially integral with said second pulley in coaxial relationship for simultaneous rotation therewith relative to said outer sleeve, said shaft of said turntable being inserted into said inner sleeve via said second pulley so as to be slidable axially relative to same;
   3. spring means within said inner sleeve yieldably urging the die on said turntable against said lapping needle via said shaft of said turntable; and 4. means for adjustably varying the force of said spring means exerted on said shaft of said turntable.

2. The ultrasonic lapping apparatus as recited in claim 1, further including means for adjustably varying the position of said cam on said disc in its radial direction whereby the amplitude of the rolling motion of said turntable is adjustable as required.

3. The ultrasonic lapping apparatus as recited in claim 1, wherein said drive means comprises:

a. a drive shaft having a first pulley fixedly mounted thereon;

b. a second pulley arranged coaxially with said turntable;

c. an endless belt extending around said first and second pulleys; and d. means for connecting said second pulley to said turntable in such a manner that said turntable is rotatable simultaneously with said second pulley and movable toward and away from same.

* * * * *